US005983049A

United States Patent [19]

Matsuya et al.

[11] Patent Number: 5,983,049

[45] Date of Patent: Nov. 9, 1999

[54] CONVEYANCE SPEED CONTROL FOR MEDIUM CONVEYANCE APPARATUS

[75] Inventors: Takashi Matsuya; Kazunori Hirose; Hironori Kanno; Kazuo Shimada, all of Kawasaki, Japan

[73] Assignee: Fujitsu Limited, Kawasaki, Japan

[21] Appl. No.: 08/994,764

[22] Filed: Dec. 19, 1997

[30] Foreign Application Priority Data

Jun. 6, 1997 [JP] Japan ..... 9-149670

[51] Int. Cl.[6] ..... G03G 15/00

[52] U.S. Cl. ..... 399/68; 399/396; 399/397

[58] Field of Search ..... 399/43, 45, 67, 399/68, 396, 397

[56] References Cited

U.S. PATENT DOCUMENTS

| | | | |
|---|---|---|---|
| 4,188,109 | 2/1980 | Idenawa et al. | 399/322 |
| 4,595,279 | 6/1986 | Kuru et al. | 399/45 |
| 5,819,149 | 10/1998 | Watanabe et al. | 399/68 X |

FOREIGN PATENT DOCUMENTS

| | | |
|---|---|---|
| 4-138485 | 5/1992 | Japan . |
| 5-69610 | 3/1993 | Japan . |

*Primary Examiner*—William Royer

*Attorney, Agent, or Firm*—Armstrong, Westerman, Hattori, McLeland & Naughton

[57] ABSTRACT

A system capable of suppressing the variation of a conveyance speed of a medium occurring when the rear end of the medium gets away from between a pair of rollers to surely and stably conduct the processing (transfer of a visible image) for the medium in a processing section (a transfer position). Accordingly, this system includes a position detecting section for detecting a position of the medium conveyed, and a control section for, when the position detecting section detects the fact that the rear end of the medium exists at a position immediately before getting away from between resist rollers, executing control so that a medium conveyance speed by the resist rollers becomes equal or substantially equal to a medium conveyance speed by conveyance rollers. This system is applicable to printers including an electrophotographic system.

5 Claims, 13 Drawing Sheets

FIG. 8

TABLE A (LOOSE)

| PAPER SIZE | LDR | | | | LGL | | | | LTR | | | | EXE | | | |
|---|---|---|---|---|---|---|---|---|---|---|---|---|---|---|---|---|
| MODE | CO | KA | RF | RB | CO | KA | RF | RB | CO | KA | RF | RB | CO | KA | RF | RB |
| 1 | -1.53% | 1.61% | 1.61% | 2.01% | -1.44% | 1.61% | 1.61% | 1.01% | -1.81% | 3.22% | 3.22% | 3.82% | -1.81% | 1.72% | 1.72% | 2.32% |
| 2 | | | | | | 1.21 | | | | | | | | | | |
| 3 | | 1.31% | | | | 1.11 | | | | 2.81 | | | | 1.51 | | |
| 4 | | | | | | 0.72 | 1.21 | 0.12 | | | | | | 1.22 | 1.44 | 2.01 |
| 5 | | | | | | | | | | | | | | | | |
| 6 | | 1.11% | | | | 0.08 | | | | 2.61 | | | | | | |
| 7 | | | | | | | | | | | | | | 0.72 | | |
| 8 | | | | | | -0.22 | | | | | | | | | | |
| 9 | | 0.72% | | | | | | | | | | | | | | |
| 10 | | | | | | -0.61 | 0.12 | | | | | | | | | |
| 11 | | | | | | | | | | | | | | | | |
| 12 | | | | | | | | | | | | | | | | |
| 13 | | | | | | -0.81 | | | | | | | | | | |
| 14 | | | | | | | | | | | | | | | | |
| 15 | | | | | | | | | | | | | | | | |
| 16 | | | | | | | | | | | | | | | | |
| 17 | | | | | | -1.01 | | | | | | | | | | |
| 18 | | | | | | | | | | | | | | | | |
| 19 | | | | | | | | | | | | | | | | |
| 20 | | | | | | | | | | | | | | | | |

FIG. 9

TABLE B

| PAPER SIZE | LDR | | | | LGL | | | | LTR | | | | EXE | | | |
|---|---|---|---|---|---|---|---|---|---|---|---|---|---|---|---|---|
| MODE | CO | KA | RF | RB | CO | KA | RF | RB | CO | KA | RF | RB | CO | KA | RF | RB |
| 1 | -1.53% | 1.91% | 1.91% | 2.31% | -1.44% | 1.91% | 1.91% | 1.31% | -1.81% | 3.42% | 3.42% | 4.01% | -1.81% | 2.01% | 2.01% | 2.61% |
| 2 | | | | | | 1.51 | | | | | | | | | | |
| 3 | | 1.61% | | | | 1.41 | | | | 3.01 | | | | 1.81 | | |
| 4 | | | | | | 1.02 | 1.51 | 0.42 | | | | | | 1.51 | 1.72 | 2.32 |
| 5 | | | | | | | | | | | | | | | | |
| 6 | | 1.41% | | | | 0.42 | | | | 2.81 | | | | | | |
| 7 | | | | | | | | | | | | | | 1.12 | | |
| 8 | | | | | | 0.01 | | | | | | | | | | |
| 9 | | 1.02% | | | | | | | | | | | | | | |
| 10 | | | | | | -0.32 | 0.42 | | | | | | | | | |
| 11 | | | | | | | | | | | | | | | | |
| 12 | | | | | | | | | | | | | | | | |
| 13 | | | | | | -0.51 | | | | | | | | | | |
| 14 | | | | | | | | | | | | | | | | |
| 15 | | | | | | | | | | | | | | | | |
| 16 | | | | | | | | | | | | | | | | |
| 17 | | | | | | -0.71 | | | | | | | | | | |
| 18 | | | | | | | | | | | | | | | | |
| 19 | | | | | | | | | | | | | | | | |
| 20 | | | | | | | | | | | | | | | | |

FIG. 10

TABLE C(NOMINAL)

| PAPER SIZE | LDR | | | | LGL | | | | LTR | | | | EXE | | | |
|---|---|---|---|---|---|---|---|---|---|---|---|---|---|---|---|---|
| MODE | CO | KA | RF | RB | CO | KA | RF | RB | CO | KA | RF | RB | CO | KA | RF | RB |
| 1 | -1.53% | 2.21% | 2.21% | 2.61% | -1.44% | 2.21% | 2.21% | 1.61% | -1.81% | 3.62% | 3.62% | 4.24% | -1.81% | 2.31% | 2.31% | 2.91% |
| 2 | | | | | | 1.81 | | | | | | | | 2.11 | | |
| 3 | | 1.91 | | | | 1.71 | | | | 3.21 | | | | 1.81 | 2.01 | 2.61 |
| 4 | | | | | | 1.32 | 1.81 | 0.73 | | | | | | | | |
| 5 | | | | | | | | | | | | | | | | |
| 6 | | 1.71 | | | | 0.73 | | | | 3.01 | | | | 1.32 | | |
| 7 | | | | | | 0.35 | | | | | | | | | | |
| 9 | | 1.32 | | | | | | | | | | | | | | |
| 10 | | | | | | -0.03 | 0.73 | | | | | | | | | |
| 11 | | | | | | | | | | | | | | | | |
| 12 | | | | | | | | | | | | | | | | |
| 13 | | | | | | -0.22 | | | | | | | | | | |
| 14 | | | | | | | | | | | | | | | | |
| 15 | | | | | | | | | | | | | | | | |
| 16 | | | | | | | | | | | | | | | | |
| 17 | | | | | | -0.41 | | | | | | | | | | |
| 18 | | | | | | | | | | | | | | | | |
| 19 | | | | | | | | | | | | | | | | |
| 20 | | | | | | | | | | | | | | | | |

FIG. 11

TABLE D(TENSION)

| PAPER SIZE | LDR | | | | LGL | | | | LTR | | | | EXE | | | |
|---|---|---|---|---|---|---|---|---|---|---|---|---|---|---|---|---|
| MODE | CO | KA | RF | RB | CO | KA | RF | RB | CO | KA | RF | RB | CO | KA | RF | RB |
| 1 | -1.53% | 2.41% | 2.41% | 2.81% | -1.44% | 2.41% | 2.41% | 1.81% | -1.81% | 3.82% | 3.82% | 4.44% | -1.81% | 2.51% | 2.51% | 3.11% |
| 2 | | | | | | 2.01 | | | | | | | | | | |
| 3 | | 2.21% | | | | 1.91 | | | | 3.42 | | | | 2.32 | | |
| 4 | | | | | | 1.51 | 2.01 | 0.92 | | | | | | 2.01 | 2.22 | 2.81 |
| 5 | | | | | | | | | | | | | | | | |
| 6 | | 1.91% | | | | 0.92 | | | | 3.21 | | | | | | |
| 7 | | | | | | | | | | | | | | 1.51 | | |
| 8 | | | | | | 0.52 | | | | | | | | | | |
| 9 | | 1.51% | | | | | | | | | | | | | | |
| 10 | | | | | | 0.21 | 0.92 | | | | | | | | | |
| 11 | | | | | | | | | | | | | | | | |
| 12 | | | | | | | | | | | | | | | | |
| 13 | | | | | | -0.03 | | | | | | | | | | |
| 14 | | | | | | | | | | | | | | | | |
| 15 | | | | | | | | | | | | | | | | |
| 16 | | | | | | | | | | | | | | | | |
| 17 | | | | | | -0.22 | | | | | | | | | | |
| 18 | | | | | | | | | | | | | | | | |
| 19 | | | | | | | | | | | | | | | | |
| 20 | | | | | | | | | | | | | | | | |

FIG. 12

TABLE E (TENSION)

| PAPER SIZE | LDR | | | | LGL | | | | LTR | | | | EXE | | | |
|---|---|---|---|---|---|---|---|---|---|---|---|---|---|---|---|---|
| MODE | CO | KA | RF | RB | CO | KA | RF | RB | CO | KA | RF | RB | CO | KA | RF | RB |
| 1 | -1.53% | 2.61% | 2.61% | 3.01% | -1.44% | 2.61% | 2.61% | 2.01% | -1.81% | 4.01% | 4.01% | 4.62% | -1.81% | 2.72% | 2.72% | 3.33% |
| 2 | | | | | | 2.22 | | | | | | | | | | |
| 3 | | 2.41% | | | | 2.11 | | | | 3.61 | | | | 2.52 | | |
| 4 | | | | | | 1.72 | 2.22 | 1.12 | | | | | | 2.22 | 2.41 | 3.01 |
| 5 | | | | | | | | | | | | | | | | |
| 6 | | 2.21% | | | | 1.12 | | | | 3.41 | | | | | | |
| 7 | | | | | | | | | | | | | | 1.72 | | |
| 8 | | | | | | 0.73 | | | | | | | | | | |
| 9 | | 1.71% | | | | | | | | | | | | | | |
| 10 | | | | | | 0.41 | 1.12 | | | | | | | | | |
| 11 | | | | | | | | | | | | | | | | |
| 12 | | | | | | | | | | | | | | | | |
| 13 | | | | | | 0.21 | | | | | | | | | | |
| 14 | | | | | | | | | | | | | | | | |
| 15 | | | | | | | | | | | | | | | | |
| 16 | | | | | | | | | | | | | | | | |
| 17 | | | | | | -0.03 | | | | | | | | | | |
| 18 | | | | | | | | | | | | | | | | |
| 19 | | | | | | | | | | | | | | | | |
| 20 | | | | | | | | | | | | | | | | |

CONVEYANCE SPEED CONTROL FOR MEDIUM CONVEYANCE APPARATUS

BACKGROUND OF THE INVENTION

1) Field of the Invention

The present invention relates to a medium conveyance apparatus for conveying a medium or media to make the medium pass through a processing section which processes (for example, transfers a visible image made with a developer) the medium under conveyance, and an image formation system for transferring a developer-made visible image onto a medium under conveyance to form the corresponding visible image on the same medium.

2) Description of the Related Art

Among image formation systems such as printers and copiers, there is an electrophotographic system in which a latent image is formed on a photosensitive unit and formed through a developer into a visible image which in turn, is transferred onto paper or a form (a sheet-like medium), one example of which has been disclosed in Japanese Unexamined Paten Publication No. 1-98529 (Japanese Paten Application No. 62-252524).

As described in the same publication, in this system. paper fed from a paper cassette is carried through a roller(s) to a transfer position, at which position a toner image formed on a surface of a photosensitive drum according to a well-known image formation procedure is transferred onto the paper fed. Following this, the paper with the transferred toner image is further conveyed to be discharged into a stacker after the toner image is fixed thereonto through the use of a fixing unit.

In such a system, the paper is conveyed in a state of being held between a preceding pair of rollers, and at this time, the front end portion of the same paper is made to be held between a succeeding pair of rollers prior to the rear end portion thereof being released from the preceding pair of rollers, so that the paper is held and conveyed by the succeeding pair of rollers after the separation from the preceding pair of rollers.

There is a problem which arises with this system, however, in that the paper traveling speed varies the moment the rear end portion of the paper is released from the preceding pair of rollers, and if this speed variation occurs in relation to paper under the transfer of a toner image at the transfer position, the toner image transferred onto the paper goes out of order. The state of this speed variation depends upon the environments including the roller temperatures.

In more detail, there is the time that the paper is conveyed in a state of being held by both the preceding and succeeding pairs of rollers as mentioned above, and the ideal is that the paper conveyance speeds due to the two sets of rollers are the same, and in practice, owing to the differences between various components such as rollers, motors and gears (put between the rotating drive shafts of the motors and the rotary shafts of the rollers for connection) on manufacturing, difficulty is experienced to always equalize the paper conveyance speeds by the two sets of rollers. In addition, if enhancing the manufacturing accuracy of the respective components in order to equalize the paper conveyance speeds, the manufacturing costs of the components increase to raise the system price. For this reason, in fact difficulty is also encountered to enhance the manufacturing accuracy of the respective components.

Therefore, taking the disorder or the like of an image transferred onto the paper into consideration, the conveyance speed due to the succeeding pair of rollers is set to be slightly higher than that by the preceding pair of rollers so that the paper is conveyed while being stretched between the preceding pair of rollers and the succeeding pair of rollers. This can prevent the occurrence of a paper waving phenomenon, and hence, in cases where the transfer position stands between the preceding pair of rollers and the succeeding pair of rollers, stable transfer is feasible at that transfer position. On the other hand, when the paper becomes free from the tension the moment that the rear end portion of the paper is released from being held between the preceding pair of rollers, the paper begins to flap and disrupts the conveyance of the rear end portion of the paper, thereby making it difficult to obtain a stable transfer of the toner image.

SUMMARY OF THE INVENTION

Accordingly, the present invention has been developed with a view to eliminating this problem, and it is therefore an object of this invention to provide a medium conveyance apparatus which is capable of controlling the variation of the conveyance of a medium arising when the rear portion of the medium gets away from between a pair of rollers, thus ensuring the certain and stable processing for the medium at a processing section.

Another object of this invention is to provide an image formation system which is capable of controlling the variation of the conveyance of a medium arising when the rear portion of the medium gets away from between a pair of rollers, thus ensuring the certain and stable transfer of a visible image onto the medium at a transfer position.

For these purposes, in accordance with the present invention, a medium conveyance apparatus which conveys a medium so that the medium passes through a processing section for processing the medium under conveyance is composed of resist rollers for conveying the medium on the upstream side of the processing section while holding the medium therebetween, conveyance rollers for conveying the medium on the downstream side of the processing section while holding the medium therebetween, a position detecting section for detecting a position of the medium conveyed, and a control section for controlling a medium conveyance speed by the resist rollers and a medium conveyance speed by the conveyance rollers so that they become equal or substantially equal to each other when the position detecting section detects that the rear end of the medium exists at a position immediately prior to getting away from between the resist rollers. With this arrangement, at the time that the rear end of the medium exits from the resist rollers, control is made so that the conveyance speeds due to the resist rollers and the conveyance rollers coincide with each other, with the result that the variation of the conveyance speed of the medium occurring in the processing section is suppressible, thus accomplishing the certain and stable processing with respect to the medium in the processing section.

On the other hand, in accordance with this invention, an image formation system is made up of an image carrier for forming an image to be transferred on a medium thereon, a transfer section disposed at a position separating from the image carrier to allow the medium to pass, for transferring the image made on the image carrier onto the medium, resist rollers for conveying the medium on the upstream side of the transfer section while holding the medium, fixing rollers for conveying the medium at the downstream side of the transfer section while holding the medium and further for fixing the image transferred onto the medium, a position detecting section for detecting a position of the medium conveyed, and a control section for controlling a medium conveyance speed by the resist rollers and a medium conveyance speed by the fixing rollers so that they become equal or substantially equal to each other when the position detecting section detects that the rear end of the medium exists at a position immediately prior to getting away from between the resist rollers. With this arrangement, at the time that the rear end of the medium exits from the resist rollers, control is made so that the conveyance speeds due to the resist rollers and the fixing rollers coincide with each other, with the result that the variation of the conveyance speed of the medium occurring at the transfer position is suppressible, thus accomplishing the certain and stable processing with respect to the medium at the transfer position.

Moreover, an image formation system according to this invention comprises, in addition to an image carrier, a transfer section, resist rollers, fixing rollers and a position detecting section as in the case of the above-mentioned image formation system, a storage section for storing medium conveyance speed information corresponding to a characteristic of the resist rollers, and a control section for controlling a medium conveyance speed by the resist rollers on the basis of the detection result of the position detecting section and the medium conveyance speed information read out from the storage section as a function of the characteristic of the resist rollers. Thus, at the time that the rear end of the medium exits from the resist rollers, the conveyance speed by the resist rollers is controlled in accordance with the characteristic of the resist rollers, with the result that the variation of the conveyance speed of the medium occurring at the transfer position is more surely suppressible, thus accomplishing the certain and stable processing with respect to the medium at the transfer position.

Furthermore, an image formation system according to this invention comprises, in addition to an image carrier, a transfer section, resist rollers, fixing rollers and a position detecting section as in the case of the above-mentioned image formation system, a storage section for storing medium conveyance speed information corresponding to an image formation mode, and a control section for controlling a medium conveyance speed by the resist rollers on the basis of the detection result of the position detecting section and the medium conveyance speed information read out from the storage section as a function of the present image formation mode. Thus, at the time that the rear end of the medium exits from the resist rollers, the conveyance speed by the resist rollers is controlled in accordance with the present image formation mode, with the result that the variation of the conveyance speed of the medium occurring at the transfer position is more surely suppressible, thus accomplishing the certain and stable processing with respect to the medium at the transfer position.

Still further, an image formation system according to this invention comprises, in addition to an image carrier, a transfer section, resist rollers, fixing rollers and a position detecting section as in the case of the above-mentioned image formation system, a temperature variation detecting section for detecting the variation of a temperature of the fixing rollers, a storage section for storing medium conveyance speed information corresponding to a temperature condition of the fixing rollers, and a control section for controlling a medium conveyance speed by the resist rollers on the basis of the detection result of the position detecting section and the medium conveyance speed information read out from the storage section as a function of the detection result of the temperature variation detecting section. Thus, at the time that the rear end of the medium exits from the resist rollers, the conveyance speed by the resist rollers is controlled in accordance with the temperature condition of the fixing rollers, with the result that the variation of the conveyance speed of the medium occurring at the transfer position is more surely suppressible, thus accomplishing the certain and stable processing with respect to the medium at the transfer position.

BRIEF DESCRIPTION OF THE DRAWINGS

FIGS. 8 to 12 are illustrations of examples of speed optimization tables to be employed for speed control of resist rollers in the printer system according to this embodiment, respectively.

DESCRIPTION OF THE PREFERRED EMBODIMENTS

An embodiment of the present invention will be described hereinbelow with reference to the drawings.

Figure 1:
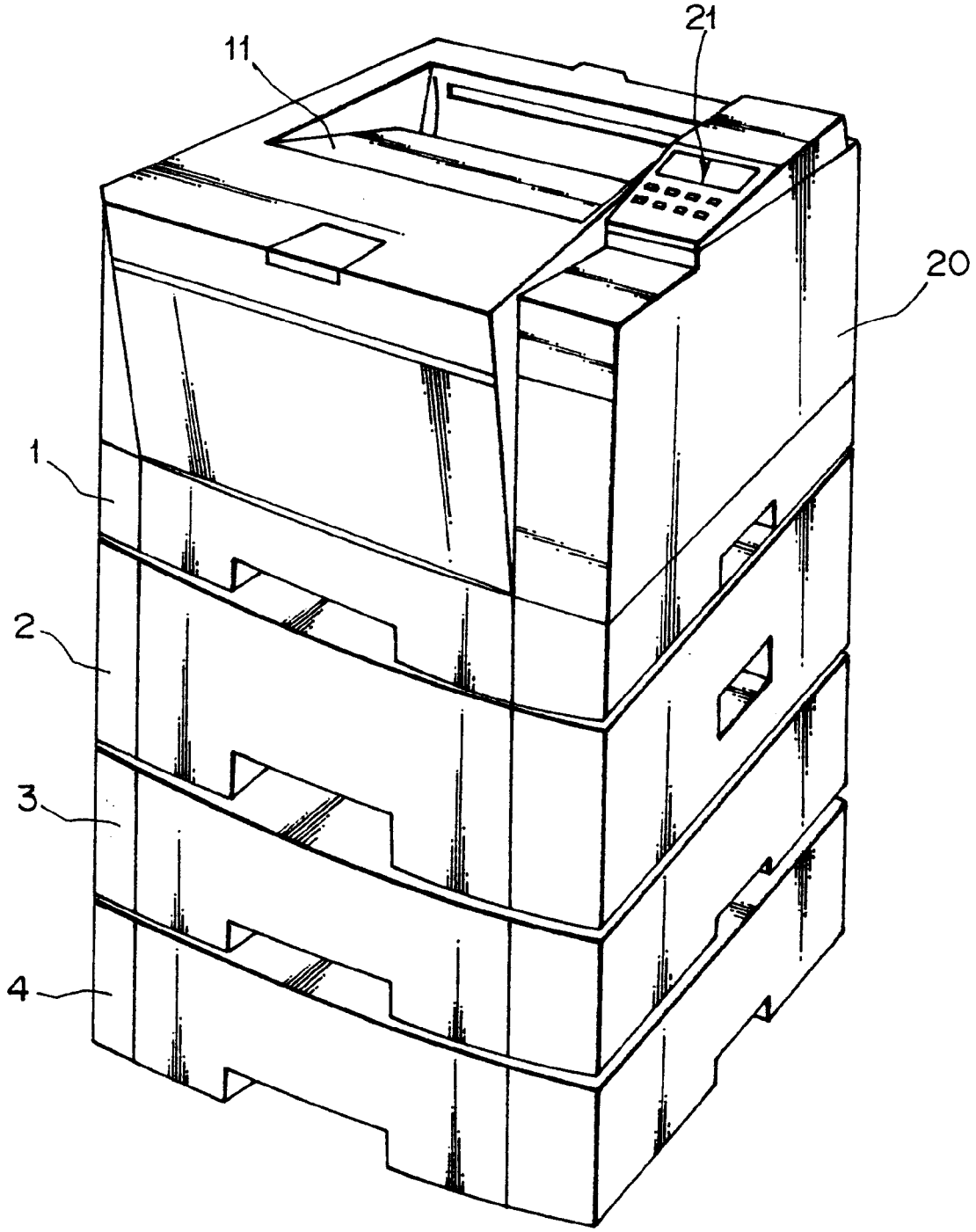
FIG. 1 is a perspective view showing an appearance of a printer system according to the present invention.

A printer system (image formation system) being an embodiment of this invention is, as shown in FIG. 1, provided with a printer body 20 for image formation and paper feeding units (a double-sided print unit 1, a second paper feeding unit 2, a third paper feeding unit 3, and a fourth paper feeding unit 4) for supplying paper (sheet-like medium) to the printer body 20.

The printer body 20 internally contains various kinds of units and a medium conveyance system for image formation as will be described herein later with reference to FIG. 2 and is, on its upper section, equipped with a stacker 11 for receiving the printed paper and for holding them and a control panel 21 through which the user operates this printer system. The control panel 21 has buttons for various setting and information inputting with respect to the printer system and a display unit not only serving to display the printer operating conditions and the printer setting conditions but also functioning as a touch panel.

Furthermore, the paper feeding units are made to be optionally mounted on the printer unit by the user when necessary, and in the example shown in FIG. 1, as the paper feeding units, there are mounted a double-sided print unit (first paper feeding unit) 1 and second to fourth paper feeding units 2 to 4 for storing paper in a piled-up condition. Although the double-sided print unit 1 can serve as a first paper feeding unit for storing paper in a piled-up condition, in this embodiment, for the double-sided print to additionally perform the printing on the rear surface of paper, it functions as a mechanism to turn paper upside down and then to supply the paper to the printer body 20. If the user stores paper different in size and type from each other in these paper feeding units 1 to 4 in accordance with the applications, the system can widely meet the print requirements from the user.

Figure 2:
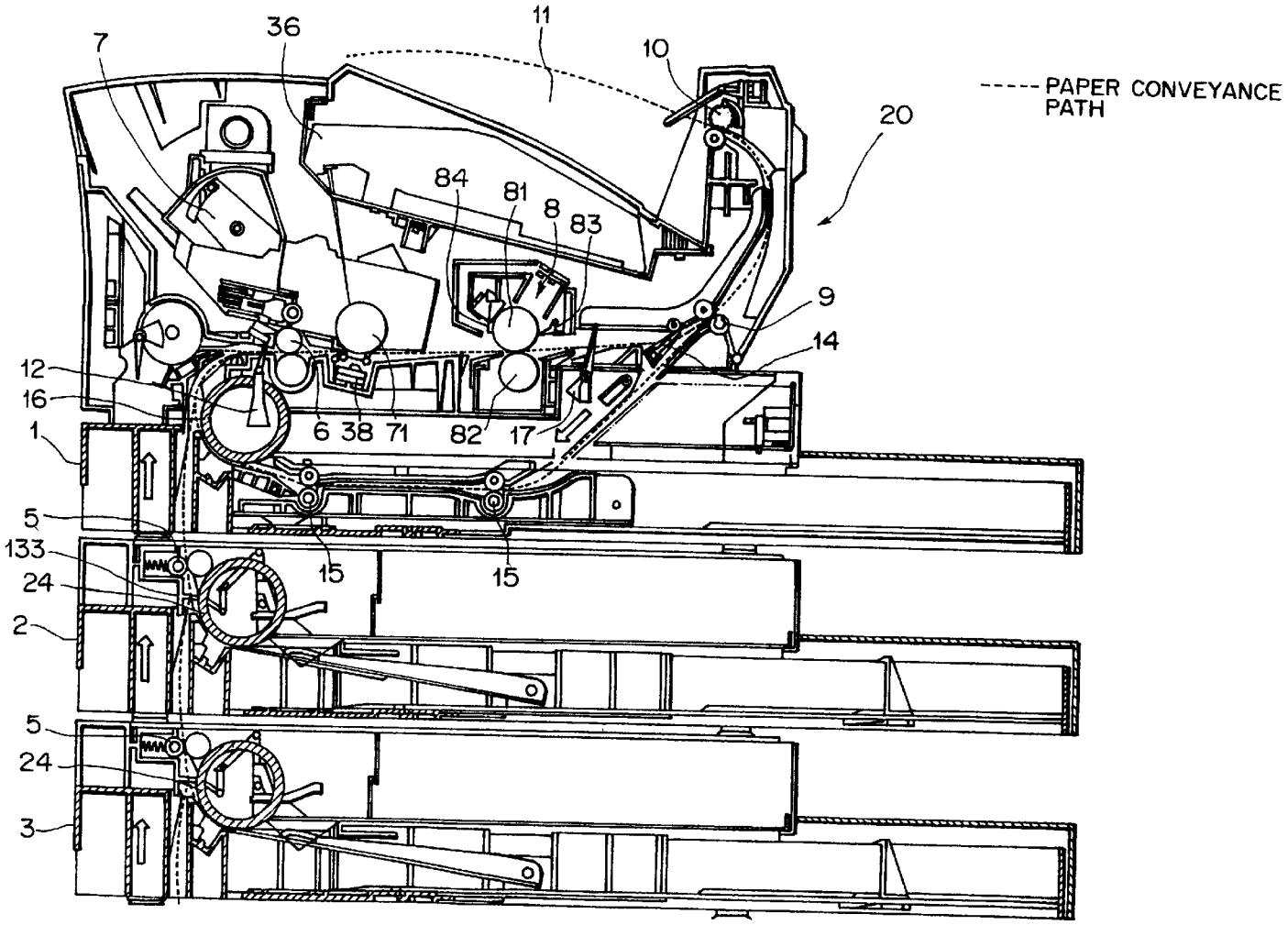
FIG. 2 is a side elevational cross-sectional view showing an internal structure of a printer system according to an embodiment of this invention.

Referring now to FIG. 2, a description will be made hereinbelow of an internal structure of the printer system according to this embodiment. In FIG. 2, the fourth paper feeding unit 4 is omitted from the illustration.

As shown in FIG. 2, each of the second paper feeding unit (first cassette 2) and the third paper feeding unit (second cassette) 3 is equipped with a pickup roller 24 for one by one drawing out the paper accumulated therein and feed rollers 5 for upwardly transferring the paper drawn out by the pickup roller 24. As will be described herein later with reference to FIG. 3, each of the paper feeding units 2, 3 is also provided with a paper size sensor 131, a paper feed motor 132 and a paper feed sensor 133. Of these components, FIG. 2 illustrates only the paper feed sensor 133 for detecting the paper drawn out from each of the paper feeding units 2, 3.

Furthermore, the double-sided print unit (first paper feeding unit) 1 includes two sets of double-side feed rollers 15 for conveying paper while holding or sandwiching therebetween so that the paper is turned upside down and fed to the printer body 20, and double-side pickup rollers 16 for forwarding the paper from the double-sided print unit 1. In this instance, when this unit 1 is used as the first paper feeding unit, the double-side pickup rollers 16 serve as pickup rollers for drawing out one by one the paper accumulated in the unit 1.

Still further, the printer body 20 internally incorporates resist rollers 6, a developing unit (print unit) 7, a fixing unit 8, first paper discharge rollers 9, second paper discharge rollers 10, a resist sensor 12, a flap gate 14, a paper discharge sensor 17, an optical unit (exposure unit) 36, transfer unit (transfer section, processing section) 38 and others. Incidentally, the printer body 20 is internally equipped with a controller 31, a mechanism control section 32 and a power supply section 34 as will be described herein later with reference to FIG. 3.

In this instance, the resist rollers 6 are paired and are for the purpose of conveying paper fed from the paper feeding unit 2 or 3, or the double-sided print unit 1 in a state of sandwiching it therebetween. The resist rollers 6 are rotationally driven (driven to rotate) by a conveyance motor 35 (see FIG. 3). The resist sensor 12 is provided on the upstream side of the resist rollers 6 to sense that the tip portion of the paper reaches the vicinity of the position at which it is held by the resist rollers 6.

The developing unit 7 contains a photosensitive drum (image carrier) 71, a developing device, a cleaner section, a destaticizer, an electrifier, and others, which are not shown in FIG. 2 except the photosensitive drum 71. These components of the developing unit are housed in one container to constitute one unit so that these components are replaceable with new ones at one time.

The photosensitive drum 71 is rotationally driven at a constant speed by a drive motor (not shown) while an image to be transferred onto paper is formed on its surface through the electrifier, the optical unit 36 and the developing device. That is, the electrifier is for the purpose of uniformly charging a surface of the photosensitive drum 71, and the optical unit 36 is for exposing the charged surface of the photosensitive drum 71 to form a latent image, and further the developing device is for developing the latent image on the photosensitive drum 71 to form a visible image (toner image). In this embodiment, the motor for rotationally driving the photosensitive drum 71 is also made to rotationally drive rollers 81, 82 of the fixing unit 8, which can lower the manufacturing cost of the system.

The transfer unit 38 is for transferring the toner image formed on the surface of the photosensitive drum 71 onto paper, and is disposed at a position separating from the photosensitive drum 71 by a distance which allows the paper to pass, to be in an opposed relation to the photosensitive drum 71 in a state that a conveyance path through which the paper passes is interposed therebetween. Further, the power supply is put to work on the transfer unit 38 at the time that the paper forwarded by the resist rollers 6 reaches the transfer position (see FIG. 7), and is controlled to come into the transferable condition.

As the transfer unit 38 there is employed a well-known transferring device using a wire. For such a transferring device, when the paper arrives at the transfer position, through the voltage applied to the wire, the toner image on the surface of the photosensitive drum 71 is sucked from the surface of the paper opposite to the print surface thereof to be attached to the print surface of the paper, so that the toner image on the photosensitive drum 71 is transferred onto the paper. The voltage to be applied to the wire of the transferring device is as high as several thousands volts, and hence, if the power supply to the transferring device is put to work early on, some troubles occur, that is, not only the time period that the power supply works gets long and the power consumption increases, but also the developer remaining on the surface of the photosensitive drum 71 is sucked to the wire to deteriorate the transfer efficiency For these reasons, it is desirable to apply the voltage to the transfer unit only for the time period of the transfer to the paper.

Furthermore, a transfer method based upon another transferring device is that a voltage is applied to a roller using a conductive rubber and, as also disclosed in Japanese Unexamined Patent Publication No. 5-346751 (Japanese Patent Application No. 4-156805), paper is put between the roller and a photosensitive drum 71 under pressure so that the toner image on the surface of the photosensitive drum 71 is transferred onto the paper, which is called a roller transfer method. However, for the roller transfer method employed, the paper is pressed against the surface of the photosensitive drum 71, and particularly, if a developing unit 7 is of the type using a developer containing a ferromagnetic carrier, the carrier remaining on the surface of the photosensitive drum 71 during the set up time for the image formation is pressed by the roller against the surface of the photosensitive drum 71, which can damage the surface of the photosensitive drum 71 by the paper or the carrier, with the result that the life of the photosensitive drum 71 becomes shorter.

On the downstream side of the aforesaid transfer unit 38, the fixing unit 8 is located to fix the toner image transferred in the transfer unit 38 onto that paper. This fixing unit 8 is based upon a well-know technique exemplified by Japanese Unexamined Patent Publication No. 1-289988 (Japanese Patent Application No. 63-119878).

As shown in FIGS. 2 and 4 to 6, this fixing unit 8 is composed of a heating roller (fixing roller) 81 and a pressure roller (fixing roller) 82.

In this case, the heating roller 81 internally has a heat source, and is rotationally driven by a drive motor (not shown; which is the same as the motor for the drive of the photosensitive drum 71).

Figure 5:
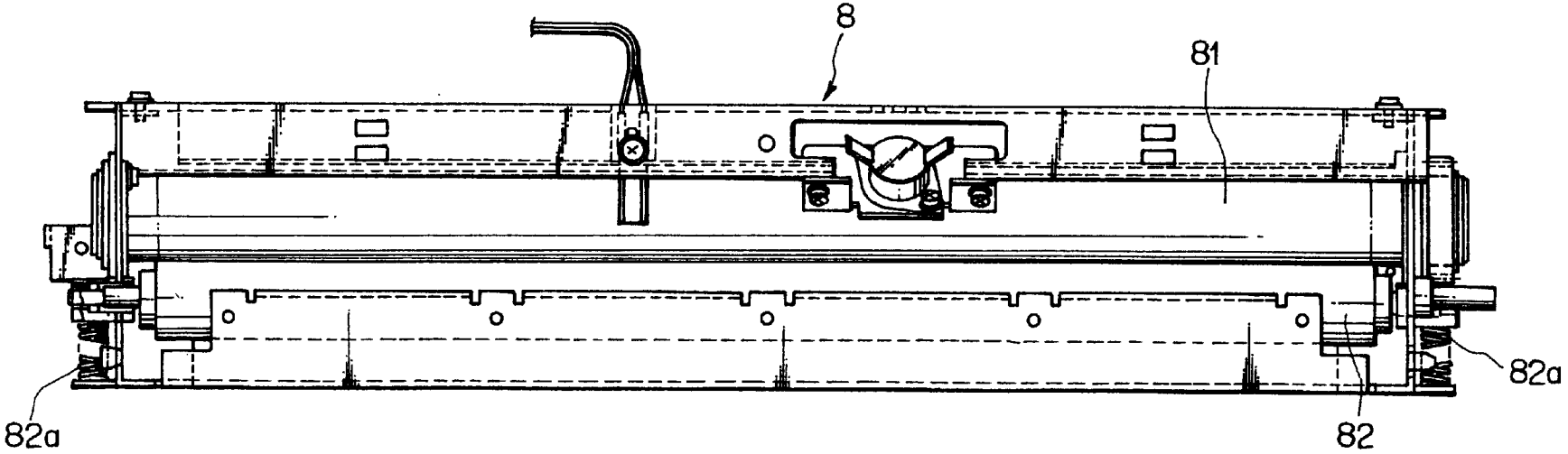
FIGS. 5 and 6 are respectively front elevational and side elevational views showing the fixing unit in the printer system according to this embodiment.
Figure 6:
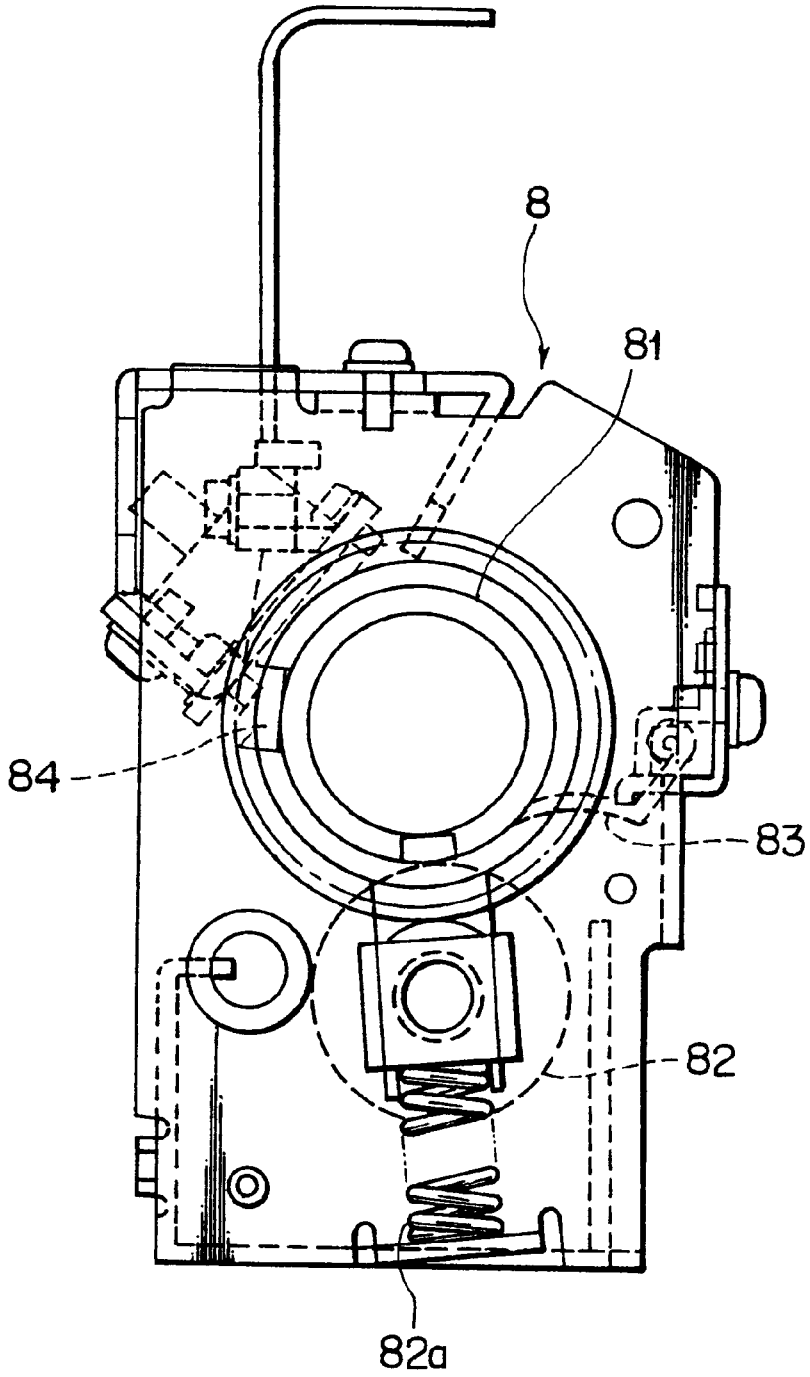

On the other hand, as shown in FIGS. 5 and 6, the pressure roller 82 has a rotary shaft whose both end portions are supported by coil springs (elastic members) 82*a*, so that the pressure roller 82 is pressed against the heating roller 81 at a given pressure caused by their elastic forces (biasing forces). The pressure roller 82 works as a driven roller which rotates in accordance with the rotation of the heating roller 81.

The heating roller 81 and the pressure roller 82 function as conveyance rollers to convey the paper while holding it therebetween on the downstream side of the transfer unit 38 (print unit 7), and concurrently, serve as fixing rollers to soften the toner to fix the toner image onto the paper in a manner of heating and pressurizing the paper held therebetween.

Furthermore, the heating roller 81 is disposed to come into contact with the print surface of the paper, and makes the surface temperature of the pressure roller 82 come close to the surface temperature of the heating roller 81 due to the heat carried from the heating roller 81, so that the toner is also heated from the rear surface side of the paper, thus improving the toner fixing efficiency. The widths of the heating roller 81 and the pressure roller 82 are set to be larger than the sizes, i.e., the widths in the conveyance direction [for example, 297 mm in A3 size (one finished paper size according to Japanese Standard Specification)] of the paper treatable in the printer system according to this embodiment.

In addition, the fixing unit 8 is equipped with a separation claw 83 for separating the paper subjected to the fixing from the heating roller 81 when that paper is adhered onto the surface of the heating roller 81, a cleaning member 84 for removing the toner attached onto the surface of the heating roller 81, and other components.

Provided on the downstream side of the fixing unit 8 are first and second paper discharge rollers 9, 10 for conveying the printed paper while holding to discharge it into the stacker 11, the flap gate 14, and the paper discharge sensor 17. Usually, the first and second paper discharge rollers 9, 10 are rotationally driven by a drive motor (not shown) in the direction of sending the paper into the stacker 11. However, they are reversely driven in order to turn the paper upside down and forward the paper into the double-sided print unit 1 for double-sided printing.

The flap gate 14 is commonly biased by a spring (not shown) to close the conveyance path from the fixing unit 8 to the stacker 11, and is designed to be put out of the way by the paper sent out of the fixing unit 8 to permit the paper from the fixing unit 8 to pass and, after the rear end of the paper passes there, to return due to the biasing force of the spring to the position of again closing the conveyance path from the fixing unit 8 to the stacker 11. This flap gate 14 exhibits a function to set the conveyance direction of the paper to inhibit the paper from returning to the fixing unit 8 side when sending the paper into the double-sided print unit 1 for double-sided printing.

The paper discharge sensor 17 is placed between the fixing unit 8 and the flap gate 14 to detect the fact that the rear end of the paper passes there, and the detection result of this paper discharge sensor 17 is used for the mechanism control section 32 (see FIG. 3) to recognize that the rear end of the paper passes through the flap gate 14. That is, as will be described herein later, the mechanism control section 32 conveys the paper by a given quantity (the value determined from a test or experiment that the paper is actually conveyed) after detecting the rear end of the paper through the use of the paper discharge sensor 17, thereby recognizing that the rear end of the paper passes through the flap gate 14.

Figure 3:
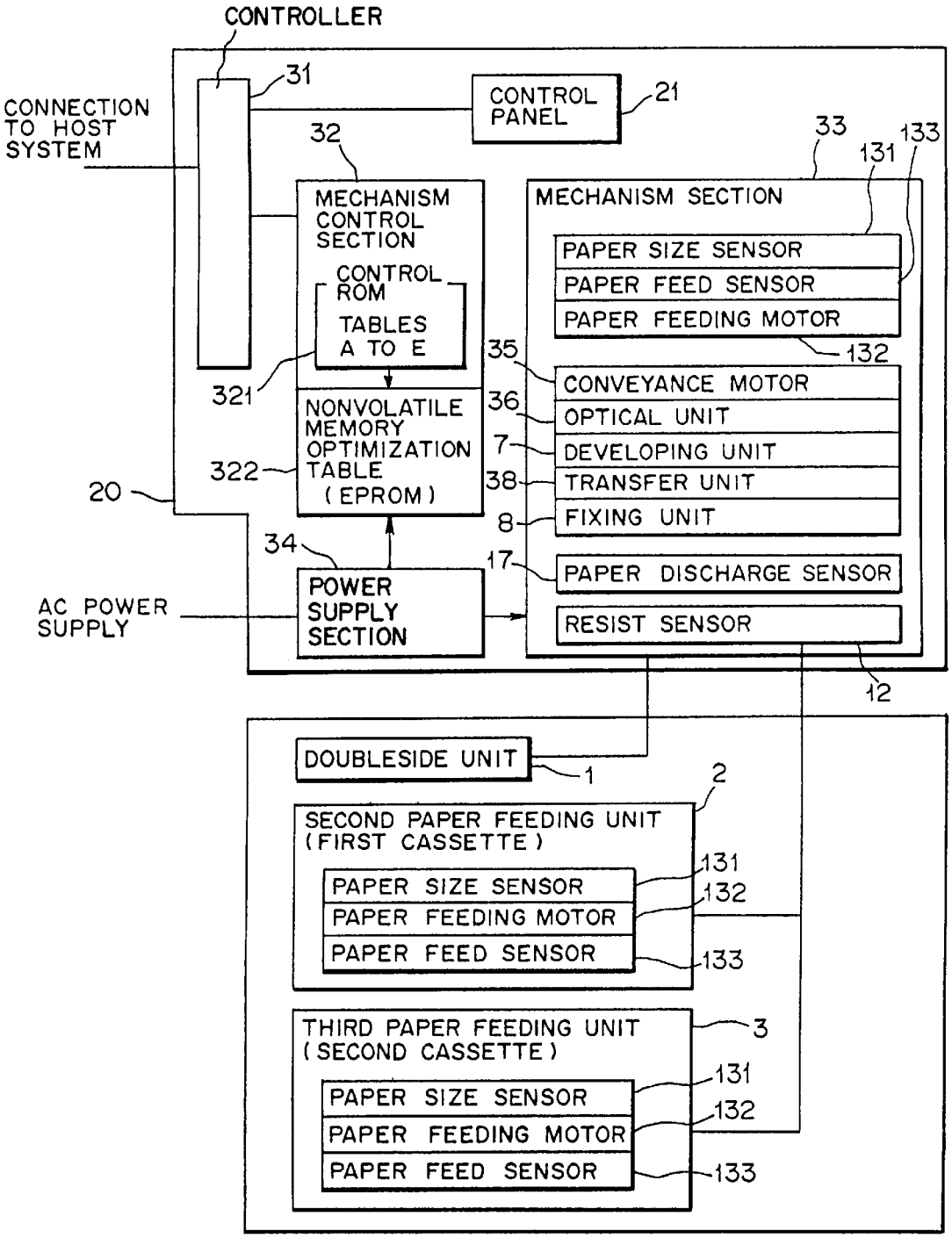
FIG. 3 is a block diagram showing an arrangement of a control system in the printer system according to this embodiment.
Figure 4:
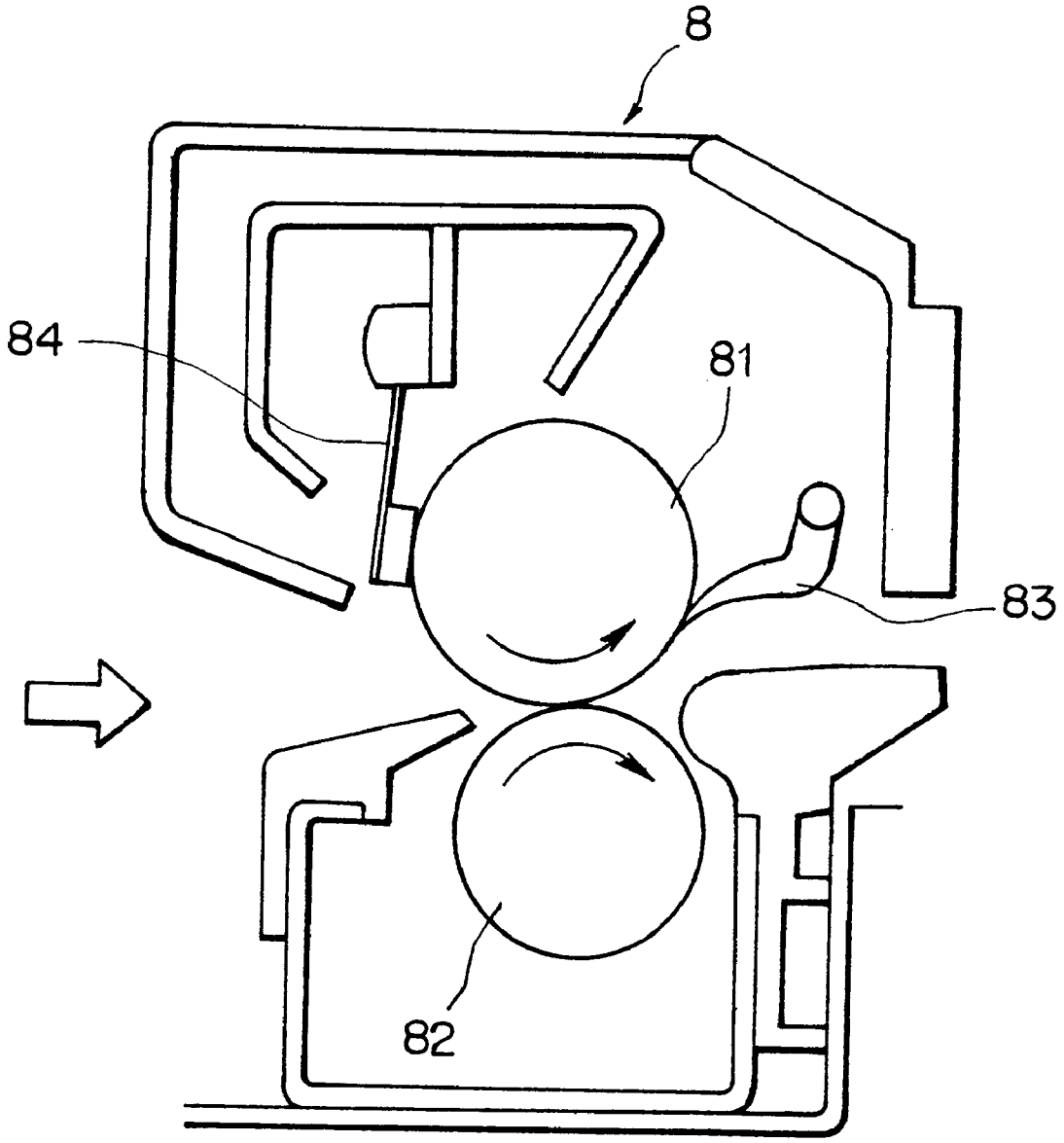
FIG. 4 is a side elevational cross-sectional view illustratively showing a fixing unit in the printer system according to this embodiment.

Secondly, referring to FIG. 3, a description will be made hereinbelow of an arrangement of a control system of the printer system according to this embodiment. In FIG. 3, the fourth paper feeding unit 4 is omitted from the illustration.

As shown in FIG. 3, each of the paper feeding units 2, 3 is equipped with a paper size sensor 131, a paper feeding motor 132, and a paper feed sensor 133. The paper size sensor 131 can accept one designated size, for example, in Japanese Unexamined Patent Publication No. 64-87431 (Japanese Patent Application No. 62-243621). More specifically, through the use of the means mounted on the paper feeding units 2, 3, the system user sets the size(s) of the paper to be placed within the paper feeding units 2, 3, so that the respective paper size sensors 131 can detect the size(s) accommodated within the paper feeding units 2, 3. Further, the paper feeding motor 132 is for rotationally driving the pickup roller 24 in each of the paper feeding units 2, 3, whereas the paper feed sensor 133 is, as mentioned before, for detecting the paper fed from each of the paper feeding units 2, 3.

In this embodiment, the printer system is connected through a network such as LAN and a printer cable to a host system (for instance, a personal computer or a server unit). Further, as shown in FIG. 3, in addition to the aforesaid control panel 21, the printer body 20 is provided with the controller 31, the mechanism control section 32, a mechanism section 33, and the power supply section 34.

The controller 31 is for generally managing the printer system according to this embodiment, that is, executes the control in accordance with the input from the control panel 21 and further, when receiving a print request from a host system, develops print data, it gets together with the print request, to fulfill a function to supply it as video data to the mechanism control section 32.

The mechanism section 33 includes not only the developing unit 7, the fixing unit 8, the optical unit 36, the transfer unit 38, the resist sensor 12 and the paper discharge sensor 17 mentioned before with reference to FIG. 2, but also the conveyance motor 35 for rotationally driving the resist rollers 6, and even a paper size sensor 131, a paper feeding motor 132 and a paper feed sensor 133 which operate when the double-sided print unit 1 is used as the first paper feeding unit. Although not shown in FIG. 3, other than the components mentioned above, the mechanism section 33 incorporates various mechanisms such as motors for driving the photosensitive drum 71 and the fixing unit 8.

The mechanism control section 32 takes charge of control for the operations of the developing unit 7, the fixing unit 8, the conveyance motor 35, the optical unit 36 and the transfer unit 38 in the mechanism section 33 and further for the operations of the paper feeding motors 132 in the paper feeding units 2, 3 on the basis of the detection results of the various sensors 12, 17, 131 and 133, thus printing the video data from the controller 31 on paper.

The mechanism control section 32 is for fulfilling various functions, for example, a typical function in a common printer system is to select one of the paper feeding units 2, 3 accommodating the paper agreeing with the print request on the basis of the detection signal from the paper size sensor 133 and to put the paper feeding motor 132 of the selected paper feeding unit 2 or 3 into operation, and further performs the following functions being the features of this invention.

That is, the mechanism control section 32 according to this embodiment functions as (1) a position detecting section for detecting the conveyed position of paper with respect to the resist rollers 6, (2) a temperature variation detecting section for detecting the temperature variation in the fixing unit 8, and (3) a control section for controlling the paper conveyance speed depending upon the resist rollers 6.

(1) The position detecting section calculates the conveyed position of paper with respect to the resist rollers 6 on the basis of the conveyance speed of the paper by the resist rollers 6 and the time taken for the conveyance to detect the fact that the rear end of the paper stands at a position immediately before getting away from between the resist rollers 6 to be released from the holding therebetween. The decision to that the rear end of the paper stands at a position immediately prior to getting away from between the resist rollers 6 to be free therefrom is made depending upon whether or not the vicinity of the rear end of the paper reaches the resist roller 6 position. In this case, according to a test, the vicinity of the rear end of the paper is appropriate to be, for instance, approximately 65 mm (35 mm in an example which will be described later) from the rear end of the paper. The value defining the vicinity of the rear end of paper can hereinafter be expressed with X mm. In more detail, in this embodiment, as will be described herein later with reference to FIG. 4, on detecting the tip of the paper by the resist sensor 12, the paper is conveyed by a given quantity to make the tip of the paper come into contact with the resist rollers 6, and subsequently, the resist rollers 6 are rotationally driven by the conveyance motor 35 to start the conveyance of the paper by the resist rollers 6. After that moment, the position detecting section calculates the conveyance quantity of the paper by the resist rollers 6 on the basis of the paper conveyance speed and the conveyance time, and detects the moment of [the calculated conveyance quantity]=[the length of the paper being currently under conveyance in the conveyance direction]−[the definition value X] as the moment immediately before the rear end of the paper gets away from between the resist rollers 6 to be free therefrom.

(2) The temperature variation detecting section detects the variation of the temperature in the fixing unit 8 as the number of paper to be continuously put into print. The temperature of the pressure roller 82 in the fixing unit 8 decreases whenever the paper passes, and gets into the stable condition when a given number of paper or more pass. Depending on the paper size, the paper conveyance speed, the paper conveyance internal and others, for example, if 10 pieces of paper are continuously put into print, the temperature of the pressure roller 82 drops to approximately 120° C. to 90° C.

(3) The paper conveyance speed control section establishes control to make the paper conveyance speed by the resist rollers 6 slightly lower than the paper conveyance speed by the rollers 81, 82 in the fixing unit 8 so that, at the ordinary paper conveyance, the paper is conveyed in a state of being stretched between the resist rollers 6 and the rollers 81, 82. Further, when the aforesaid position detecting section detects that the rear end of the paper stands at a position immediately previous to getting away from between the resist rollers 6 to be released from the holding therebetween, the paper conveyance speed control section has control so that the paper conveyance speed by the resist rollers 6 becomes equal or substantially equal to the paper conveyance speed by the rollers 81, 82.

Particularly, the paper conveyance speed control section according to this embodiment controls the paper conveyance speed by the resist rollers 6 on the basis of the characteristic of the resist rollers 6, the present image formation mode and the detection result of the aforesaid temperature variation detecting section immediately before the rear end of the paper is free from the holding between the resist rollers 6. In fact, the paper conveyance speed control section indirectly controls the paper conveyance speed by the resist rollers 6 in a manner of controlling the operating condition of the conveyance motor 35.

For the foregoing control based upon the characteristic of the resist rollers 6, the present image formation mode and the detection result of the aforesaid temperature variation detecting section, the paper conveyance speed control section is provided with a control ROM table (storage section) 321 and a nonvolatile memory (EPROM, storage section) 322.

As will be described herein later with reference to FIGS. 8 to 12, a plurality of (5 in this embodiment) speed optimization tables A to E corresponding to the characteristic of the resist rollers 6 (the characteristic of the printer system) are previously registered as paper conveyance speed information with the control ROM table 321. In this embodiment, a print test is made at the shipment of the printer system so that the speed optimization table meeting the test result is selected from the control ROM table 321 and then stored in the EPROM 322. As will be described herein later with reference to FIGS. 8 to 12, each of the speed optimization tables includes the paper conveyance speed information corresponding to the present image formation mode (for example, front surface print at one-sided print and double-sided print or rear surface print at double-sided print) and the detection result (the number of sheets of paper already put into print or how many sheets from the initiation at a continuous printing operation) of the aforesaid temperature variation detecting section.

Furthermore, the aforementioned paper conveyance speed control section reads out the paper conveyance speed information corresponding to the present image formation mode and the number of printed paper sheets from the speed optimization table in the EPROM 322, and, on the basis of the read-out paper conveyance speed information, controls the paper conveyance speed by the resist rollers 6 immediately before the rear end of the paper is free from the holding between the resist rollers 6.

The power supply section 34 is coupled to an external AC power source for supply of power to the respective portions in the printer system. Particularly, it supplies a high voltage to the developing unit 7 and the transfer unit 38 which carry out the corona discharge.

Moreover, referring to FIGS. 2 and 7, a description will be taken hereinbelow of the basic operation of the printer system thus arranged according to this embodiment.

In putting paper into print in the printer system, as shown in FIG. 2, the pickup roller 24 draws out one by one paper accumulated within the second paper feeding unit 2 or the third paper feeding unit 3. This paper is conveyed upwardly while being held between the feed rollers 5, and further carried while being held between the resist rollers 6 so that the toner image formed in the developing unit 7 is transferred onto the same paper at the transfer unit 38. The paper with the toner image transferred is forwarded to the fixing unit 8 where the toner image is fixed on the paper by means of heat and pressure. Further, the paper after the fixing is conveyed through the first paper discharge rollers 9 and the second paper discharge rollers 10 to be discharged into the stacker 11. In the above-mentioned printing operation according to this embodiment, an image is formed in accordance with a well-known image formation procedure disclosed, for instance, in Japanese Unexamined Patent Publication No. 1-98529 (Japanese Patent Application No. 62-252524), thus accomplishing the printing on the paper.

As mentioned before, the mechanism control section 32 (see FIG. 3) selects the paper feeding unit 2 or 3 accommodating paper conforming with the print request on the basis of the detection signal of the paper size sensor 131, and actuates the paper feeding motor 132 for the selected paper feeding unit 2 or 3 to rotationally drive the pickup roller 24. Assuming the case of selecting the second paper feeding unit 2, a description will be made hereinbelow of the basic operation of the printer system according to this embodiment with reference to FIG. 7.

Figure 7:
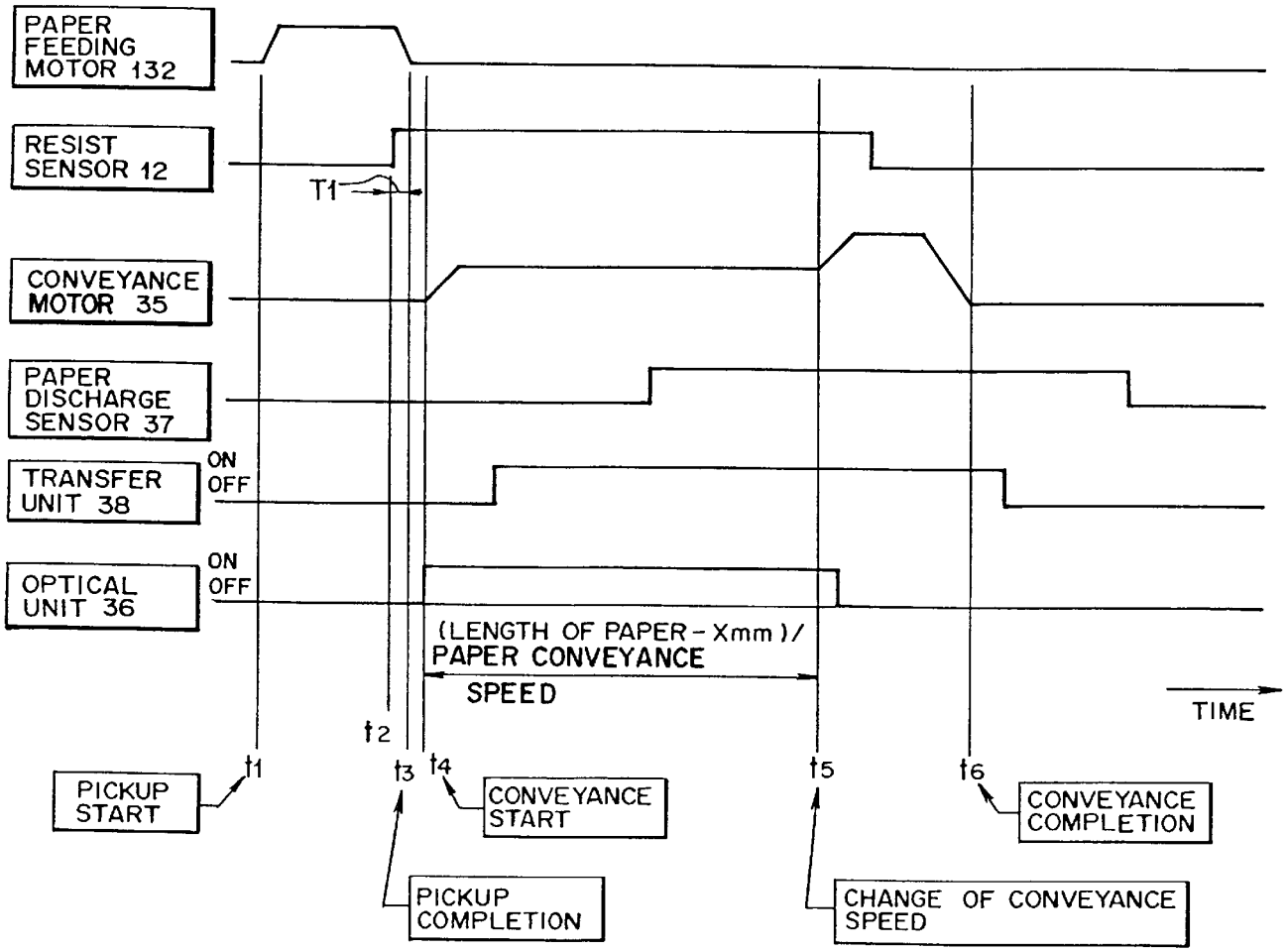
FIG. 7 is a time chart useful for explaining an operation of the printer system according to this embodiment.

The paper feeding motor 132 of the second paper feeding unit 2 is put into operation to rotationally drive the pickup roller 24, thus initiating the pickup operation (time tI in FIG. 7). With the rotation of the pickup roller 24 and the feed rollers 5 in the paper conveyance direction, the paper accommodated within the second paper feeding unit 2 is drawn out by one and then sent upwardly. The decision on whether or not the paper is drawn out from the second paper feeding unit 2 is made on the basis of the detection result of the paper feed sensor 133. More specifically, if no detection of the paper arises by the paper feed sensor 133 regardless of the rotation of the pickup roller 24 by a given quantity, the mechanism control section 32 makes a decision that the paper is not normally drawn out therefrom, and temporarily stops the draw-out of the paper and then again carries out the draw-out operation. On the other hand, if the paper feed sensor 133 detects the paper until the pickup roller 24 rotates by the given quantity, the mechanism control section 32 makes a decision to the normal draw-out of the paper therefrom, and hence, continues the conveyance of the paper.

Furthermore, in this embodiment, the resist sensor 12 detects the tip portion of the paper coming through the pickup roller 24 and the feed rollers 5 (time t2 in FIG. 7), and subsequently, continues the conveyance of the paper by a quantity (time period T1 in FIG. 7) predetermined through a test. The mechanism control section 32 operates the paper feeding motor 132 by the corresponding set quantity to convey the paper, thereafter stopping the paper feeding motor 132. Whereupon, the tip portion of the paper is brought into contact with the resist rollers 6 to correct an inclined condition of the paper. At this step, the pickup of the paper from the second paper feeding unit comes to completion (time t3 in FIG. 7).

In response to the stop of the paper feeding motor 132, the mechanism control section 32 immediately operates the conveyance motor 35 to rotationally drive the resist rollers 6 to start the conveyance of the paper by the resist rollers 6 (time t4 in FIG. 7).

Following this, the paper is conveyed by the resist rollers 6 to the transfer unit 38 where the toner image formed on the surface of the photosensitive drum 71 is transferred onto the paper, and subsequently, the paper is further conveyed by the resist rollers 6 to the fixing unit 8. In the fixing unit 8, the paper is interposed between the heating roller 81 and the pressure roller 82 so that the toner is softened and the toner image is fixed onto the paper owing to the heat and pressure. The paper subjected to the fixing processing in the fixing unit 8 advances to put the flap gate 14 out of the way. In the case of the one-sided print, after passing through the flap gate 14, the paper is discharged into the stacker 11 by means of the first and second paper discharge rollers 9, 10.

In the case of the double-sided print, after the print on the front surface of the paper is done in accordance with the same printing operation as that for the one-sided print, the paper is conveyed through the paper discharge rollers 9, 10 until the rear end thereof passes through the flap gate 14. The mechanism control section 32 detects the rear end of the paper through the use of the paper discharge sensor 17 and then recognizes the passing of the rear end of the paper through the flap gate 14 in a manner of conveying the paper by a given quantity (a value determined through a test of actually conveying paper), and reversely drives the paper discharge rollers 9, 10 at the moment of recognizing that the rear end of the paper passes through the flap gate 14. Consequently, the paper conveyed in the opposite direction passes under the flap gate 14 and goes to the double-sided print unit 1, and then is again conveyed to the upstream side of the resist rollers 6 by the double-side feed rollers 15 and the double-side pickup rollers 16. The same printing operation as that in the aforesaid one-sided print is conducted with respect to the paper thus turned upside down, so that the rear surface of the paper is put into print. After the completion of the printing operation for the rear surface, the paper is discharged into the stacker 11 by the paper discharge rollers 9, 10 after the fixing processing is done in the fixing unit 8 in a similar way.

In this embodiment, at the ordinary paper conveyance, the paper conveyance speed by the resist rollers 6 is controlled to be slightly lower than the paper conveyance speed by the rollers 81, 82 in the fixing unit 8, and in a state of being conveyed while being held between the resist rollers 6 and between the rollers 81, 82, the paper is stretched between the resist rollers 6 and the rollers 81, 82, with the result that the waving phenomenon of the paper does not occur, which ensures the stable transfer at the transfer position existing between the resist rollers 6 and the fixing unit 8. However, the paper is released from the tension the moment that the rear end portion of the paper is free from being held between the resist rollers 6 and, hence, comes into contracting condition, the conveyance of the rear end portion of the paper becomes out of order, thereby making difficult the stable transfer.

For this reason, in this embodiment, at the time (time t5 in FIG. 7) that the paper conveyed position by the resist rollers 6 arrives at the vicinity of the rear end thereof, i.e., 65 mm (X mm) from the rear end thereof, the mechanism control section 32 increases the paper conveyance speed by the resist rollers 6. At this time, in accordance with the flow chart of FIG. 13, the mechanism control section 32 reads out the paper conveyance speed information corresponding to the present image formation mode and the number of paper printed from the speed optimization table stored in the EPROM 322 to control the paper conveyance speed by the resist rollers 6 (the conveyance motor 35). A detailed description of this control operation will be made later with reference to FIG. 13. Further, after changing the speed of the resist rollers as mentioned before, the conveyance motor 35 is stopped at the time (time t6 in FIG. 7) that the paper gets away from between the resist rollers 6.

Furthermore, a description will be taken hereinbelow of the speed optimization tables in this embodiment. In the printer system according to this embodiment, the print for paper of A3 size (420 mm in length by 297 in width) is possible. On the other hand, for effective printing, the paper of A4 size (297 mm in length by 210 mm in width) is conveyed in the transverse direction being the direction of the shorter dimension (in this case, the length of the paper in the feeding direction is 210 mm). A3 and A4 are finished paper size according to the Japanese Standard Specification.

In the printer system according to this embodiment shown in FIG. 2, the resist rollers 6 are disposed to separate by approximately 125 mm from the fixing unit 8 (the rollers 81, 82). Accordingly, there is a time that paper is held and conveyed by both the resist rollers 6 and rollers 81, 82 in the fixing unit 8. In this embodiment, during that time, the paper conveyance speed by the resist rollers 6 is controlled to be slightly lower than the paper conveyance speed by the rollers 81, 82 in the fixing unit 8 as mentioned before, so that the paper is stretched between the resist rollers 6 and the fixing unit 8. Now that the waving phenomenon or the like of the paper disappears as mentioned before, the transfer is stably feasible at the transfer position between the resist rollers 6 and the fixing unit 8. However, since the paper contracts because of being released from the tension the instant that the rear end of the paper gets away from between the resist rollers 6, the conveyance of the rear end of the paper becomes out of order, so that there is a possibility that difficulty is encountered to stably achieve the transfer.

In addition, in the fixing unit 8, the fixing processing is done in a state where the paper is held between the heating roller 81 and the pressure roller 82 as mentioned above. At this time, the surface temperature of the heating roller 81 is controlled to reach 180° C. in the print preparation finished condition, and in this case, the surface temperature of the pressure roller 82 receives the heat from the heating roller 81 to come to 120° C.

In the case of the continuous paper printing, two consecutive papers are successively conveyed in a state of being separated by approximately 35 mm from each other. When the fixing processing is conducted for the toner image transferred paper, the heat of the pressure roller 82 is absorbed by the paper undergoing the fixing processing, and even if the heating roller 81 and the pressure roller 82 directly come into contact with each other in the separation (approximately 35 mm) between the preceding and succeeding paper, the surface temperature of the pressure roller 82 does not rise up to 120° C. For this reason, if continuously conducting the printing in terms of approximately 10 sheets of paper, the surface temperature of the pressure roller 82 drops to 90° C. However, thereafter, the surface temperature of the pressure roller 82 becomes stable at approximately 90° C. The degree of decrease in temperature depends upon the paper size.

The pressure roller 82 decreases in volume in connection with the temperature drop from 120° C. to 90° C., and therefore, the circumferential length of the pressure roller 82 becomes accordingly shorter.

Moreover, since the heating roller 81 and the pressure roller 82 are longer than the widths of paper, the temperature of the central portion of the pressure roller 82 is absorbed by the paper to drop. However, since both the end portions of the pressure roller 82 where the paper does not exist are always placed into direct contact with the heating roller 81, no temperature drop occurs. Accordingly, the difference in temperature between the central portion and both end portions of the pressure roller 82 occurs, which causes the difference in circumferential length between the central portion and both end portions of the pressure roller 82, with the result that the paper conveyance performance of the central portion of the pressure roller 82 deteriorates and the paper conveyance speed varies.

In addition, when the heating roller 81 works for the continuous printing, the temperature and volume of the heating roller 81 also decreases although not so much as those of the pressure roller 82, with the result that the paper conveyance speed in the fixing unit 8 reduces.

Accordingly, such a speed variation works in the paper contracting direction the moment that the rear end of the paper is free from being held between the resist rollers 6, and hence, it is more difficult to stabilize the conveyance condition of the rear end of the paper, and further difficult to establish the stable transfer.

For these reasons, in this embodiment, in order to prevent the paper from getting out of order the instant that the rear end of the paper is released from being held between the resist rollers 6, the paper conveyance speed by the resist rollers 6 is increased (that is, the paper conveyance speed by the resist rollers 6 and the paper conveyance speed by the rollers 81, 82 are controlled to be substantially equal to each other) the moment that (immediately before) the rear end of the paper is free from being held between the resist rollers 6. Whereupon, it is possible to cancel the stretched and conveyed condition of the paper between the resist rollers 6 and the fixing unit 8 the moment that the rear end of the paper gets away from between the resist rollers 6.

At this time, if the paper conveyance speed by the resist rollers 6 is merely increased to reach one target speed, this can not cope with the foregoing change of the conveyance speed occurring in conjunction with the temperature variation (the paper size and the number of paper to be continuously printed) of the fixing unit 8, with the result that there is a possibility that the paper conveyance gets out of order.

One possible solution to suppress the temperature variation of the pressure roller 82 is to also mount a heat source on the pressure roller 82. However, this additionally requires components including the heat source, a temperature control circuit for the heat source and a temperature detecting circuit, thereby resulting in the increase in size and manufacturing cost of the system, that is, causing difficulty in providing a low-costed and small-sized printer system.

In this embodiment, for the purpose of surely avoiding the occurrence of the conveyance disturbance of paper without causing the increase in size and cost of the system, the printer system has the speed optimization tables shown in FIGS. 8 to 12, and the mechanism control section 32 changes the speed of the resist rollers 6 on the basis of the paper conveyance speed information set in the tables.

If determining the paper conveyance speed taking only the temperature of the fixing unit 8 into consideration, only one speed optimization table is available. However, for coping with the manufacturing errors of the various components organizing the printer system (the characteristic of the resist rollers 6, that is, the characteristic of the printer system), it is desirable that a plurality of kinds of speed optimization tables are prepared, and selected in accordance with the characteristic of the printer system (the characteristic of the resist rollers 6) and put to use.

For this reason, in this embodiment, in order to deal with the print disturbance due to the manufacturing errors occurring in the mass production of the system, for instance, 5 kinds of speed optimization tables A to E are prepared as shown in FIGS. 8 to 12 and selected in accordance with the characteristic of the printer system (the characteristic of the resist rollers 6) obtained from the test result at the system shipment.

Referring to FIGS. 8 to 12, a description will be taken hereinbelow of the paper conveyance speed information set in the speed optimization tables A to E. The values of the paper conveyance speed information indicated in the respective tables A to E are the ratios (%) to the process speed 83 mm/sec, and the mechanism control section 32 refers to the ratio to control the operating condition of the conveyance motor 35 (i.e., the paper conveyance speed by the resist rollers 6).

The values of the paper conveyance speed information set in these optimization tables A to E are determined in such a manner as to manufacture a printer system and to actually put into print. If the value(s) of the paper conveyance speed information is prepared at every paper size or at every conveyance direction, it is possible to more certainly suppress the print disturbance. In the tables A to E, the values of the paper conveyance speed information are prepared in terms of four kinds of paper sizes: LDR (ledger size: generally corresponding to A3 according to Japanese Standard Specification), LGL (legal size: generally corresponding to B4 according to Japanese Standard Specification), LTR (letter size: generally corresponding to A4 according to Japanese Standard Specification), and EXE (executive size: generally corresponding to B5 according to Japanese Standard Specification). The paper conveyance speed information for the LTR size takes a value in the case of the conveyance in the transverse direction.

The mode in each of the tables A to E signifies the kinds of image formation modes such as one-sided print and double-sided print, and in each of the tables A to E, the values of the paper conveyance speed information are prepared corresponding to four kinds of modes CO, KA, RF and RB at every paper size mentioned above.

In this instance, the CO column shows the ordinary paper conveyance speeds, that is, the values of information about the paper conveyance speed by the resist rollers 6 when the tip portion of paper is held between the resist rollers 6 to shift the paper up to the vicinity of its rear end.

The KA column shows the values of information about the paper conveyance speed by the resist rollers 6 at the vicinity of the rear end of the paper in the case of conducting only the one-sided print.

The RF column shows the values of information about the paper conveyance speed by the resist rollers 6 at the vicinity of the rear end of the paper in the case of putting the front surface of the paper into print (the surface to be initially put into print) in the double-sided print.

The RB column shows the values of information about the paper conveyance speed by the resist rollers 6 at the vicinity of the rear end of the paper in the case of putting the rear surface of the paper into print (the surface to be later put into print) in the double-sided print.

In the tables A to E shown in FIGS. 8 to 12, the values are shown provided that the value (the position from the rear end of paper) X defining the vicinity of the rear end of paper is taken to be 35 mm.

In addition, in each of the tables A to E, the values of the paper conveyance speed information corresponding to how many sheets from the initiation at continuous printing operation are prepared at every mode mentioned above. In this case, it is sufficient having values corresponding to the number of sheets which cause the surface temperature of the pressure roller 82 to drop whenever the paper passes and then to come into a stable condition.

In this embodiment, since the surface temperature of the pressure roller 82 comes into a stable condition when 20 sheets of paper are continuously put into print, the values of the paper conveyance speed information are prepared corresponding to the respective paper at every mode in cases where 20 sheets of paper are continuously put into print.

The state that the surface temperature of the pressure roller 82 drops depends upon the paper conveyance speed, the interval between paper at the continuous printing operation, the temperature/material of the fixing unit 8 and other factors and differs among the printer systems. Accordingly, in fact, the values of the paper conveyance speed information need to be attained from test at every printer system. However, like this embodiment, if five kinds of speed optimization tables A to E shown in FIGS. 8 to 12 are prepared, it is possible to cope with the print disturbance due to the manufacturing errors occurring at the mass production of the printer system, and to reduce the print disturbance to the extent of being invisible by human eyes. That is, in each of the five kinds of speed optimization tables A to E, the values of the paper conveyance speed information agreeing with five typical characteristics of the printer system are set corresponding to the paper size, the image formation mode and the number of sheets of paper to be continuously output into print, and therefore, if a test is made in terms of each printer system manufactured and one table is selected in accordance with its characteristics, it is possible to cope with the characteristics of each printer system.

These tables A to E are stored in the control ROM 321 shown in FIG. 3, which permits them to be easily mounted in each printer system at a low cost.

Furthermore, for selecting one agreeing with the printer system from the plurality of optimization tables A to E, in terms of the systems manufactured, the print test is actually made through the use of the tables A to E at the system shipment as mentioned before. The printed matter obtained as the test result is compared with the printed matters corresponding to the tables A to E, and the printed matter with the least print disturbance is employed as the speed optimization table for that system which in turn, is stored in the nonvolatile memory (EPROM) 322 of the same system. After the system shipment, the mechanism control section 32 controls the paper conveyance speed by the resist rollers 6 in accordance with the stored table. This selection and setting of the optimization table can be made through the control panel 21 or made through the controller 31 from a host system coupled to the printer system at the print test.

Figure 13:
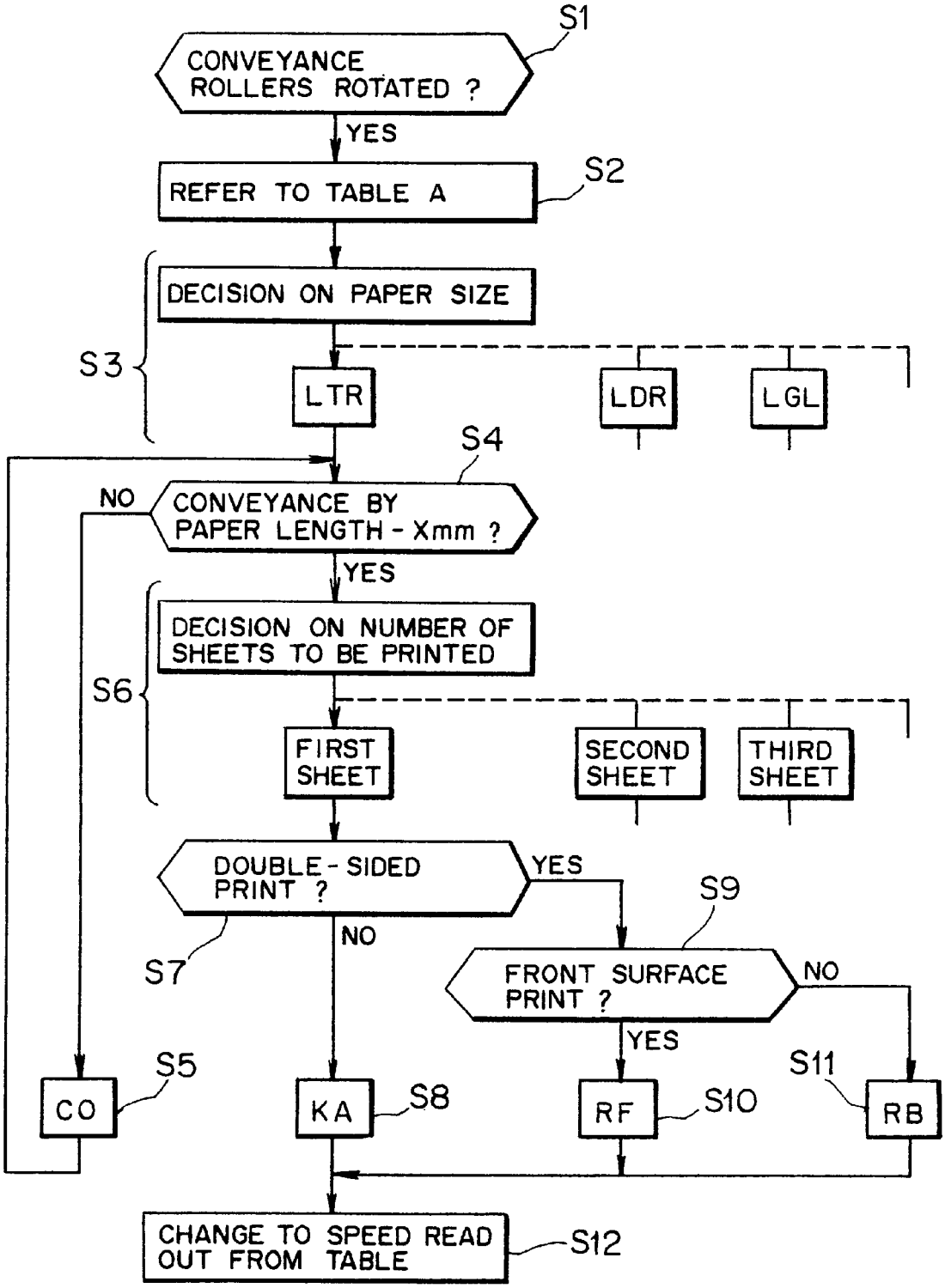
FIG. 13 is a flow chart available for describing a control operation of the control system in the printer system according to this embodiment.

Referring to the flow chart (steps S1 to S12) of FIG. 13, a description will be made hereinbelow of a paper conveyance speed control operation the mechanism control section 32 according to this embodiment conducts in the case that the speed optimization table A shown in FIG. 8 is selected and set in the EPROM 322.

When a print request is made from a host system, the controller 31 sends data necessary for the printing to the mechanism control section 32. The mechanism control section 32 selects one of the paper feeding units 2, 3, which accommodates paper with a size agreeing with the print request, on the basis of the data from the controller 31 and the detection result of the paper size sensor 131. In this case, let it be assumed that, for instance, a print request is issued for the paper with the LTR size and the paper with the LTR size are set in the second paper feeding unit 2. The mechanism control section 32 selects the second paper feeding unit 2 and actuates the paper feeding motor 132 of that paper feeding unit 2 so that the pickup roller 24 one by one draws out the paper in the paper feeding unit 2 and forwards it upwardly.

Furthermore, as described before with reference to FIG. 7, after the resist sensor 12 detects the tip of the paper conveyed by the pickup roller 24 and the feed rollers 5, the paper is shifted by a given conveyance quantity whereby the tip of the paper comes into contact with the resist rollers 6. The mechanism control section 32 actuates the conveyance motor 35 immediately after stopping the paper feeding motor 132, thus conveying the paper through the resist rollers 6 ("YES" route from step S1).

At this time, the mechanism control section 32 refers to the optimization table A set in the nonvolatile memory 322 (step S2) to conduct the following processing.

That is, first, the mechanism control section 32 decides the paper size and selects the data corresponding to the paper size LTR in the speed optimization table A (step S3).

Secondly, a decision is made on whether or not the paper conveyed position reaches the vicinity of the rear end of the paper, that is, whether or not the paper is conveyed by [the length of the paper]−X (35 mm) from its tip position (step S4). If the paper conveyed position does not reach the vicinity of the rear end of the paper ("NO" route in step S4), the speed of the resist rollers 6 is controlled on the basis of the value (−1.81%) in the CO column belonging to the LTR column in the speed optimization table A (step S5). At the initiation of the paper conveyance, naturally the paper conveyed position is not the vicinity of the rear end of the paper, and therefore, the speed of the resist rollers 6 is controlled on the basis of the value −1.81% in the CO column. As a result, the resist rollers 6 convey the paper at a speed of 81.50 mm/sec lower than the process speed 83 mm/sec.

Thereafter, the paper is conveyed by the resist rollers 6 and a toner image formed on the surface of the photosensitive drum 71 is transferred onto the paper by the transfer unit 38. The paper onto which the toner image is transferred is further conveyed by the resist rollers 6 to arrive at the fixing unit 8. Further, when the paper position conveyed by the resist rollers 6 reaches the vicinity of the rear end of the paper, i.e., is of 35 mm from the rear end thereof ("YES" route in step S4; see time t5 in FIG. 7), the speed of the resist rollers 6 is changed through the processing in steps S6 to S12.

In this case, a decision is made on how many paper sheets from the print start in the continuous printing operation (step S6), and a decision is made on whether or not this printing operation is for the double-sided print (step S7), and further, if being for the double-sided print, a decision is made on whether or not this printing operation is for the front surface printing (step S9). Subsequently, the value corresponding to the number of paper sheets to be put into print and the image formation mode is read out from within the LTR column of the speed optimization table A (steps S8, S10, S11) so that the speed of the resist rollers 6 is changed on the basis of that value (step S12).

Describing in more detail, in the case of a one-sided print ("NO" route from step S7), the value corresponding to the number of paper sheets to be put into print is read out from within the KA column belonging to the LTR column of the optimization table A (step S8) so that the speed of the resist rollers 6 is changed on the basis of that value (step S12). For instance, for printing a first paper sheet, the value 3.22% is read out to control the speed of the resist rollers 6 on the basis of that value 3.22%. Consequently, the resist rollers 6 convey the paper at a speed of 85.67 mm/sec.

Furthermore, in the case of a double-sided print ("YES" route in step S7) and the print for the front surface ("YES" route in step S9), the value corresponding to the number of paper sheets to be put into print is read out from within the RF column belonging to the LTR column of the optimization table A (step S10) so that the speed of the resist rollers 6 is changed on the basis of that value (step S12). For instance, for the print made for the first paper sheet, the value 3.22% is read out and the speed of the resist rollers 6 is controlled on the basis of that value 3.22%.

Still further, in the case of the double-sided print ("YES" route in step S7) and the print for the rear surface ("NO" route in step S9), the value corresponding to the number of paper sheets to be put into print is read out from within the RB column belonging to the TLR column of the optimization table A (step S11) so that the speed of the resist rollers 6 is changed on the basis of that value (step S12). For instance, for the print made for the first paper sheet, the value 3.82% is read out and the speed of the resist rollers 6 are controlled on the basis of that value 3.82%.

In the case of the double-sided print, after a toner image on the photosensitive drum 71 is transferred onto a paper front surface, the toner image is fixed thereonto in the fixing unit 8. Since in the fixing unit 8 the heat and the pressure are applied to the paper for the fixing, the moisture contained in the paper evaporates to slightly shrink the paper. Accordingly, for the rear surface of the paper put into print, if the paper is conveyed at the same speed as that in the rear surface print, at the time that the toner image on the photosensitive drum 71 is transferred onto the paper, the image extends as compared with the case of the print for the paper front surface. For this reason, in this embodiment, different modes are respectively allocated to the front surface print (RF) and the rear surface print (RB), and different values of the paper conveyance speed information are set in relation to these modes to make a difference between the paper conveyance speed at the front surface print and the paper conveyance speed at the rear surface print. This can more certainly suppress the paper conveyance speed variation which tends to occur during toner image transfer onto the paper.

As described above, in a printer system according to one embodiment of this invention, at the time that the rear end of the paper gets away from between the resist rollers 6, the paper conveyance speed by the resist rollers 6 is controlled in accordance with the characteristic of the resist rollers 6 (the characteristic of each printer system), the present image formation mode (one-side print, double-sided print, and others), the temperature condition of the pressure roller 82 (the number of paper sheets to be put into print), and the paper size, thus surely suppressing the variation in paper conveyance speed which occurs at the transfer position between the photosensitive drum 71 and the transfer unit 38. Accordingly, the transfer of a visible image onto the paper is certainly and stably feasible.

Incidentally, the paper conveyance system (the medium conveyance apparatus according to this invention) applied to the printer system (the image formation system) according to this embodiment is applicable to various types of processing systems (a medium processing system which conveys a medium in a state of holding it by the preceding and succeeding pairs of rollers to conduct any processing with respect to the medium) other than the printer system. In this case, the same effects as those mentioned above are attainable, and the processing to the medium is surely and stably possible.

What is claimed is:

1. A medium conveyance apparatus which conveys a medium so that said medium passes through a processing section for processing said medium under conveyance, said apparatus comprising:

resist rollers for conveying said medium on the upstream side of said processing section while holding said medium therebetween;

conveyance rollers for conveying said medium on the downstream side of said processing section while holding said medium therebetween;

a position detecting section for detecting a position of said medium conveyed; and a control section for controlling a medium conveyance speed by said resist rollers and a medium conveyance speed by said conveyance rollers so that they become equal or substantially equal to each other when said position detecting section detects that a rear end of said medium exists at a position immediately prior to getting out from between said resist rollers.

2. An image formation system comprising:

an image carrier for forming an image to be transferred on a medium thereon;

a transfer section disposed at a position separating from said image carrier to allow said medium to pass, for transferring said image formed on said image carrier onto said medium;

resist rollers for conveying said medium on the upstream side of said transfer section while holding said medium therebetween;

fixing rollers for conveying said medium at the downstream side of said transfer section while holding said medium therebetween and further for fixing an image transferred onto said medium;

a position detecting section for detecting a position of said medium conveyed; and a control section for controlling a medium conveyance speed by said resist rollers and a medium conveyance speed by said fixing rollers so that they become equal or substantially equal to each other when said position detecting section detects that a rear end of said medium exists at a position immediately prior to getting out from between said resist rollers.

3. An image formation system comprising:

an image carrier for forming an image to be transferred on a medium thereon;

a transfer section disposed at a position separating from said image carrier to allow said medium to pass, for transferring said image formed on, said image carrier onto said medium;

resist rollers for conveying said medium on the upstream side of said transfer section while holding said medium therebetween;

fixing rollers for conveying said medium at the downstream side of said transfer section while holding said medium therebetween and further for fixing an image transferred onto said medium;

a position detecting section for detecting a position of said medium conveyed;

a storage section for storing medium conveyance speed information corresponding to a characteristic of said resist rollers; and a control section for controlling a medium conveyance speed by said resist rollers on the basis of a detection result of said position detecting section and said medium conveyance speed information read out from said storage section in accordance with said characteristic of the resist rollers.

4. An image formation system comprising:

an image carrier for forming an image to be transferred on a medium thereon;

a transfer section disposed at a position separating from said image carrier to allow said medium to pass, for transferring said image formed on said image carrier onto said medium; resist rollers for conveying said medium on the upstream side of said transfer section while holding said medium therebetween;

fixing rollers for conveying said medium at the downstream side of said transfer section while holding said medium therebetween and further for fixing an image transferred onto said medium;

a position detecting section for detecting a position of said medium conveyed;

a storage section for storing medium conveyance speed information corresponding to an image formation mode; and a control section for controlling a medium conveyance speed by said resist rollers on the basis of a detection result of said position detecting section and said medium conveyance speed information read out from said storage section in accordance with the present image formation mode.

5. An image formation system comprising:

an image carrier for forming an image to be transferred on a medium thereon;

a transfer section disposed at a position separating from said image carrier to allow said medium to pass, for transferring said image formed on said image carrier onto said medium;

resist rollers for conveying said medium on the upstream side of said transfer section while holding said medium therebetween;

fixing rollers for conveying said medium at the downstream side of said transfer section while holding said medium therebetween and further for fixing an image transferred onto said medium;

a position detecting section for detecting a position of said medium conveyed;

a temperature variation detecting section for detecting a variation of temperature of said fixing rollers;

a storage section for storing medium conveyance speed information corresponding to a temperature condition of said fixing rollers; and a control section for controlling a medium conveyance speed by said resist rollers on the basis of a detection result of said position detecting section and said medium conveyance speed information read out from said storage section in accordance with a detection result of said temperature variation detecting section.

* * * * *